United States Patent [19]

Rohner

[11] 4,236,288

[45] Dec. 2, 1980

[54] METHOD OF FABRICATING HEAT TRANSFER CONDUITS

[75] Inventor: Peter Rohner, Isernhagen, Fed. Rep. of Germany

[73] Assignee: Kabel-und Metallwerke Gutehoffnungshuette AG, Fed. Rep. of Germany

[21] Appl. No.: 57,706

[22] Filed: Jul. 16, 1979

[51] Int. Cl.[3] ..... F28D 15/00; B21D 53/02; F25B 15/00

[52] U.S. Cl. ..... 29/157.3 H; 29/157.3 R; 165/105

[58] Field of Search ..... 29/157.3 H, 157.3 R

[56] References Cited

U.S. PATENT DOCUMENTS

| | | | |
|---|---|---|---|
| 3,498,369 | 3/1970 | Levedahl | 165/105 |
| 4,180,127 | 12/1979 | Maxson | 29/157.3 R |

*Primary Examiner*—Leon Gilden
*Assistant Examiner*—V. Rising
*Attorney, Agent, or Firm*—James C. Jangarathis

[57] ABSTRACT

A method of fabricating a plurality of heat transfer conduits is disclosed wherein an elongated metal pipe is evacuated, a predetermined quantity of heat transfer fluid is placed within such evacuated pipe and the pipe ends sealed airtight. The elongated sealed pipe is wound in a helical or serpentine configuration, the lower vertical portions of the so configured pipe are heated so that the liquid phase of the heat transfer fluid is evaporated and redistributed in an even manner in the lower vertical portions of successive convolutions of such pipe, and is then flattened, for example, at each of its upper vertical portions to form vacuum-tight seals between adjacent convolutions. A cutting procedure across each of the flattened upper portions (or selected ones of such flattened upper portions) enables a separation of the elongated sealed pipe into a plurality of heat transfer conduits without the necessity of a further evacuation procedure.

3 Claims, 3 Drawing Figures

METHOD OF FABRICATING HEAT TRANSFER CONDUITS

The invention relates to an improved method for making a plurality of heat transfer conduits each of which is comprised of a closed pipe in which there is provided a suitable fluid for transferring heat between two locations at different temperatures. More particularly, the invention relates to a method of fabricating a plurality of heat transfer conduits or pipes from a once evacuated long length of metal pipe which has been sealed at its end portions and within which the liquid phase of the heat transfer fluid is distributed in a predetermined manner.

A priorly known type of heat transfer conduit or pipe comprises a closed pipe filled with a suitable heat transfer fluid which evaporates at a location with a higher temperature (heating zone) and condenses at a location with a lower temperature (cooling zone). The interior space of such a vacuum-tight closed system has a heat transfer fluid which is partly present in liquid form and partly as saturated vapor, with the heat transfer fluid evaporating in the heating zone and flowing to the cold zone, where it condenses and thereby releases its heat of evaporation. If the cooling zone lies above the heating zone, the condensate will flow back into the heating zone on account of gravity and such devices for returning are called heat siphons. If the condensate is returned by the use of capillary forces, the device usually is called a heat pipe. The heat transfer fluid is circulated by means of the temperature difference between the heating zone and the cooling zone, which is frequently very small. The higher vapor pressure which prevails in the heating zone provides a pressure gradient which drives the vapor to the cooling zone. An essential advantage of these heat transfer devices is that their effective heat conductivity is orders of magnitude higher than that of the best metallic conductors. In addition, such devices are easy to handle and maintenance-free, and heat can be transferred counter to gravity. Such heat transfer devices, however, must each first be evacuated, subsequently filled with a predetermined quantity of heat transfer fluid, and then closed air tight.

Priorly known heat transfer conduits or pipes may comprise a drawn, seamless, soft-annealed, thin-walled copper pipe or a corrugated metal pipe with a welded seam along its length. The soft-annealed, thin-walled copper pipes, as well as the corrugated metal pipes with welding longitudinal seams, are flexible and thus may be formed in a helical, spiral or serpentine configuration.

It is the object of the present invention to provide an improved method of fabricating a plurality of heat transfer conduits or pipes, that eliminates the work intensive operations of multiple evacuations by requiring (i) only an initial single evacuation in combination with (ii) a single step of insertion of a predetermined quantity of heat transfer fluid, in the mass fabrication of a plurality of discrete heat transfer conduits.

The aforesaid object is obtained, inter alia, by first evacuating an elongated metal pipe, inserting a predetermined quantity of heat transfer fluid therein, and providing airtight seals at the opposite ends thereof. The elongated sealed pipe is then formed in a helical or serpentine configuration, and the lower vertical portions thereof heated so that the liquid phase of the heat transfer fluid is evaporated and distributed in an even manner in each of the successive lower vertical portions of the convolutions of the elongated sealed pipe. The successive upper vertical portions of the convolutions of the elongated sealed pipe (or selected ones of such upper vertical portions) are flattened to form vacuum-tight seals between adjacent convolutions, thus providing a plurality of successive individually sealed, heat transfer conduits.

In accordance with the method of the present invention, a plurality of discrete heat transfer conduits have been fabricated from an elongated sealed metal pipe having a length of approximately 400 meters, wound on a supply drum and partially immersed into a heated water bath. The heating of those portions of the convolutions of the elongated metal pipe immersed in the hot bath (and, where necessary, the cooling of the portions of the convolutions not extending into the bath) has been found to cause an even distribution of the heat transfer fluid throughout the entire length of the elongated metal pipe within a short period of time. The successive upper vertical portions furthest from the hot bath were compressed flat and transversely cut to form a plurality of individually sealed, discrete heat transfer conduits. Such discrete conduits were straightened, but they can be brought in any desired form as well.

The invention will be further described with respect to the accompanying drawings wherein.

Figure 1:
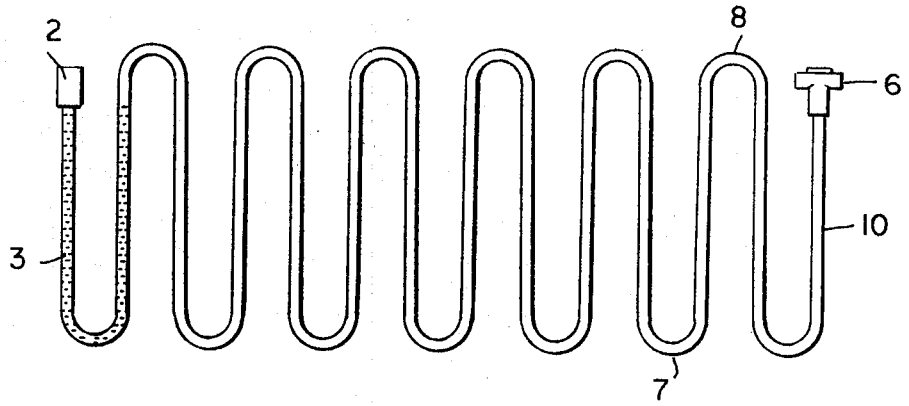
FIG. 1 is a simplified elevation view of an elongated metal pipe having a predetermined quantity of heat transfer fluid inserted therein upon an evacuation of the pipe and the airtight sealing of its end portions.

Each of the convolutions so formed is a heat transfer conduit that may be separated in the flattened zone from the adjacent convolution simultaneously with the flattening procedure without any evacuation procedure in addition to the initial evacuation of the elongated metal pipe depicted in FIG. 1.

Figure 2:
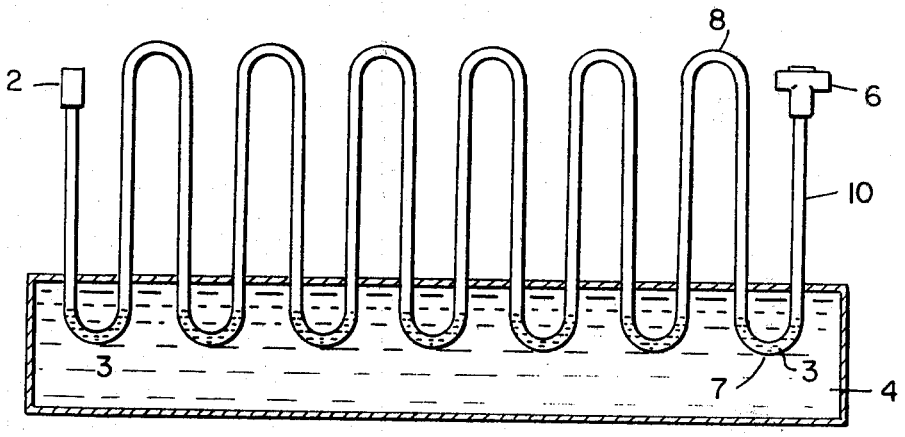
FIG. 2 is a simplified elevation view of the elongated metal pipe of FIG. 1, formed in a serpentine configuration and partially inserted in a heat bath so that the liquid phase of the heat transfer fluid is distributed in an even manner throughout the convolutions of the metal pipe by evaporation and condensation.
Figure 3:
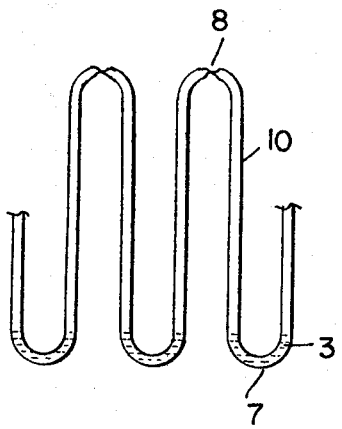
FIG. 3 is a partial elevation view of segments of the elongated metal pipe illustrated in FIG. 3, having had the liquid phase of the heat transfer fluid evenly distributed in the lower portions of the convolution of such pipe, and having the upper portions of such convolutions flattened and sealed so as to form a vacuum-tight seal between adjacent convolutions.

FIGS. 1–3 illustrate in sequential order the state of fabrication resulting from the employment of the various steps of the present invention for the manufacture of a plurality of heat transfer conduits or pipes.

With reference to FIG. 1, there is illustrated an elongated metal pipe 10 wound into a serpentine configuration, advantageously fabricated from a copper band whose walls are, for example, 0.3 mm thick. In a continuous operating process, this band is formed into an open seam pipe, welded along its length, and subsequently corrugated for increased flexibility. Alternatively, a seamless drawn copper tube may be employed as the elongated metal pipe 10. After being finally drawn, such a tube is soft annealed and is consequently quite flexible.

One end of the elongated metal pipe 10 is sealed vacuum-tight by means of a cap 2, while the other end is provided with coupling and sealing cap 6 for connecting pipe 10 to a vacuum pump (not shown) for evacuating pipe 10, inserting a predetermined quantity of a heat transfer fluid 3 into pipe 10, and then sealing such other end of pipe 10 vacuum tight.

With reference to FIG. 2, the elongated metal pipe 10 filled and sealed as noted above with regard to FIG. 1 (which may be wound on a drum (not shown) or formed in a serpentine configuration), is partially immersed in a water bath 4 of, for example, 60° C. Consequently, a portion of the heat transfer fluid 3 from lower vertical portion 7 of the metal pipe 10 is evaporated into upper vertical portion 8 of the convolutions of the metal pipe 10 wherein condensation occurs. The condensate then flows downward from the unheated upper vertical portions 8 and redistributes the liquid state of the heat transfer fluid 3 into the lower vertical portions 7 of adjacent convolutions of the metal pipe 10. In this manner, there is achieved an even distribution of the heat transfer fluid 3 into each of the successive convolutions of the metal pipe 10 between each of the successive upper vertical portions 8.

With a pair of pliers (not shown) each upper vertical portion 8 is flattened in a manner to form a vacuum-tight seal between adjacent convolutions (see FIG. 3), and transversely cut in the flattened upper vertical portion 8 so as to provide a plurality of discrete, individually sealed heat transfer conduits without further evacuation procedures.

Numerous modifications and variations of the present invention are possible in light of the above teachings and, therefore, within the scope of the appended claims the invention may be practiced otherwise than as particularly described.

I claim:

1. A method of fabricating a plurality of heat transfer conduits comprising the steps of:

evacuating an elongated metal pipe;

inserting a predetermined quantity of heat transfer fluid within such evacuated pipe, and providing airtight seals at the opposite ends thereof;

further comprising the steps of:

winding the elongated sealed pipe to form vertical convolutions;

heating the lower vertical portions of such convolutions so that the liquid phase of the heat transfer fluid is redistributed in a predetermined manner in said lower vertical portions; and providing vacuum-tight seals between adjacent convolutions of said metal pipe in at least selected upper vertical portions of said convolutions.

2. The method in accordance with claim 1 wherein said vacuum-tight seals between adjacent convolutions of said metal pipe are provided by flattening said upper vertical portions so that the pipe walls come together in the flattened area, and consecutively cutting the pipe in the flattened area for separating the elongated pipe into a plurality of individually sealed heat transfer conduits.

3. The method in accordance with claim 1 wherein the elongated metal pipe is wound on a drum to form said vertical convolutions and said lower vertical portions of such convolutions are heated by the lowering of the drum partially within a hot water bath.

* * * * *